US006431955B1

(12) United States Patent
Toschi

(10) Patent No.: US 6,431,955 B1
(45) Date of Patent: Aug. 13, 2002

(54) METHOD, DEVICE AND PLANT FOR CLEANING IRREGULAR PIECES CONSISTING OF DIFFERENT MATERIALS

(75) Inventor: Angelo Toschi, Castellarano (IT)

(73) Assignee: Pescale S.p.A., Castellarano (IT)

( * ) Notice: Subject to any disclaimer, the term of this patent is extended or adjusted under 35 U.S.C. 154(b) by 0 days.

(21) Appl. No.: 09/529,980

(22) PCT Filed: Aug. 21, 1999

(86) PCT No.: PCT/EP99/06140

§ 371 (c)(1),
(2), (4) Date: Aug. 1, 2000

(87) PCT Pub. No.: WO00/10753

PCT Pub. Date: Mar. 2, 2000

(30) Foreign Application Priority Data

Aug. 24, 1998 (IT) ..... CO98A0014

(51) Int. Cl.[7] ..... B24B 1/04; B24B 31/02

(52) U.S. Cl. ..... 451/32; 451/35; 451/326; 451/330

(58) Field of Search ..... 451/32, 34, 35, 451/326, 328, 329, 330

(56) References Cited

U.S. PATENT DOCUMENTS 2,600,206 A 6/1952 Christensen

FOREIGN PATENT DOCUMENTS

| | | |
|---|---|---|
| DE | 12 87 423 | 1/1969 |
| EP | 0 714 703 | 6/1996 |
| FR | 2 201 150 | 4/1974 |
| FR | 2 296 484 | 7/1976 |

*Primary Examiner*—M. Rachuba
(74) *Attorney, Agent, or Firm*—Young & Thompson

(57) ABSTRACT

A method, a device and a plant for cleaning irregular pieces consisting of different materials, for example cast iron pieces with parts of compressed coal dust sticking thereon and coal pieces made of compressed coal dust with parts of a contaminating film adhering thereon, wherein the cleaning of both materials is carried out in only one cleaning device comprising a cleaning jacket which has a substantially horizontal longitudinal axis, is rotatable in both directions of rotation, is pivoted in order to swing in the vertical longitudinal plane, and is provided with cleaning tools which are fastened to the cleaning jacket along jacket generating lines or helicoidal lines. The cleaning tools have two geometrical different operative sides in order to form an active side for each of both materials to be cleaned when rotating in an associated direction of rotation.

20 Claims, 6 Drawing Sheets

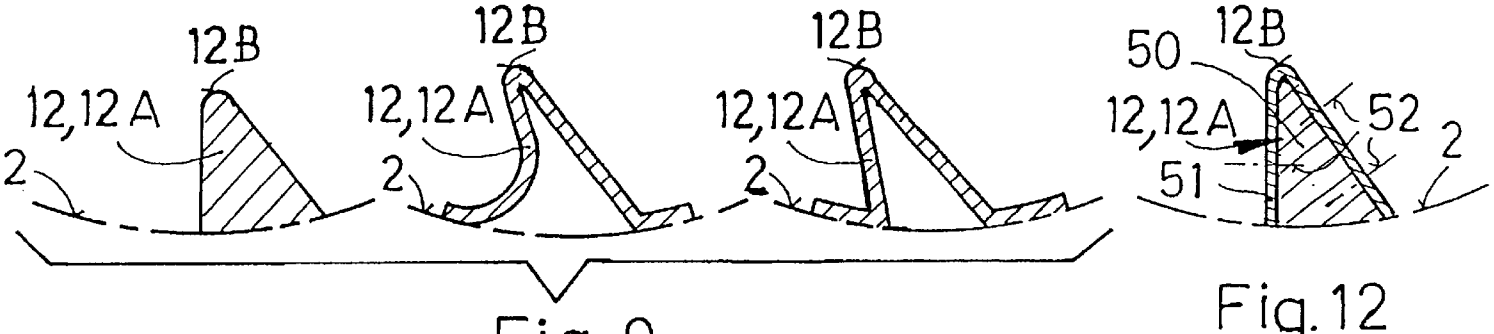
Fig. 9
Fig. 12
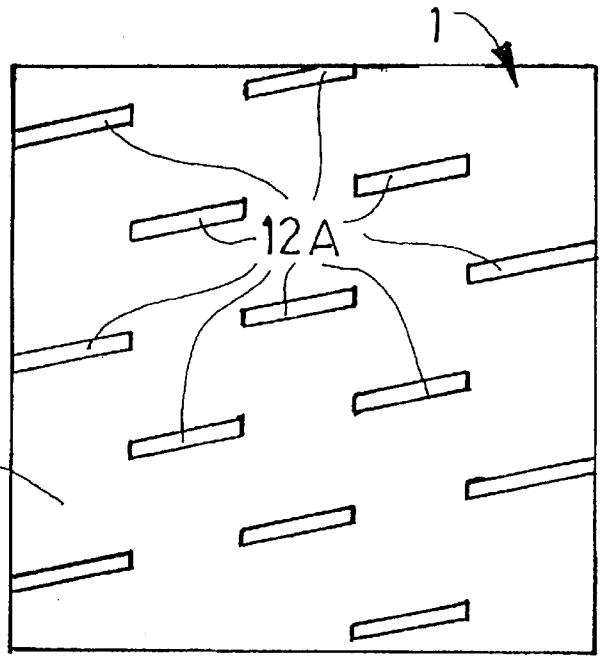
Fig. 11
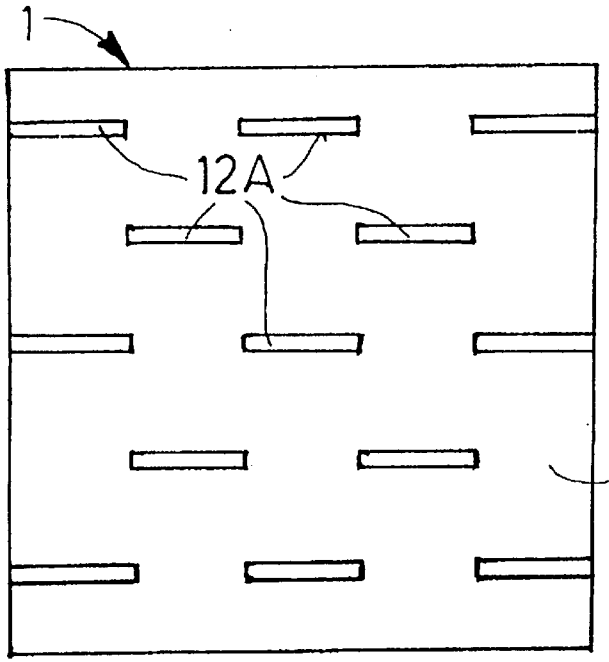
Fig. 10

METHOD, DEVICE AND PLANT FOR CLEANING IRREGULAR PIECES CONSISTING OF DIFFERENT MATERIALS

CROSS REFERENCE TO RELATED APPLICATION

This is the 35 USC 371 national stage of international application PCT/EP99/06140 filed on Aug. 21, 1999, which designated the United States of America.

TECHNICAL FIELD OF THE INVENTION

The present invention relates to a method, a device and a plant for cleaning irregular pieces of different materials.

BACKGROUND OF THE INVENTION

It should be understood that in the context of the present specification with the terms "cleaning" or "treating" is meant a removing action for removing from material pieces an agglomerated material sticking or adhering thereon.

As it is known, for example, from pyrolysis processes, so called parallelepipedical "cakes" or blocks consisting of compressed coal dust incorporating in the upper side thereof cup-like elements of cast iron in which may be engaged teeth of a translation rod for moving said blocks. During the stay time of said blocks in the treating baths an irregular thin contaminating layer called in the art terminology "contaminating film" is formed onto the block outer surface.

Due to cost reasons it is desirable to recover or recuperate both a cleaned metallic fraction or component, that is the cast iron pieces from which the sticking coal parts have been removed, as well as a cleaned coal fraction or component, that is the coal pieces from which the sticking contaminating film parts have been removed.

The cleaning or recovering step is usually preceded by a preliminary breaking of said coal blocks and cast iron elements into smaller pieces. These obtained smaller cast iron pieces may have a granulometry at will.

Said breaking step can practically occur in different ways and provides—as mentioned above—a component of cast iron pieces having coal dust agglomerations sticking thereon and a component of compressed coal dust pieces bearing portions of said contaminating film thereon, the volume ratio between said components being, for example, of about 1 to 20.

The cleaning treatment of both the component of cast iron pieces and the component of coal pieces, are carried out with rather empirical methods, for example by tumbling for the cast iron pieces or by a manual scrapping or by abrasion by means of a sand jet for both the metal and coal pieces. These methods require a long treatment/cleaning time indeed, are noisy, cause the formation and emission of a great quantity of contaminating volatile coal dust, and have a low efficiency due to both the weak separation/removing action, particularly in the case of said cast iron pieces, and the difficulties to remove in a reliable and complete way said contaminating film from the coal pieces.

Due to the different features and hardness of the cast iron and coal pieces it is further known to utilize two separated, independent and rather long tumbling barrel-like devices, and more precisely: one for treatment/cleaning the metallic component, and another for removing said contaminating film from the coal pieces. This obviously requires a considerable expenditure in investments, equipment, personnel, and installation surface.

The presence of volatile coal dust, particularly of the contaminating coal dust, is harmful for the operators, causes pollution, and requires a costly plant for eliminating the coal dust.

Although in the present specification reference is made to said above mentioned "cakes" or blocks for pyrolysis processes, the teaching of the present invention refers without limitations to the cleaning of any other product requiring a similar cleaning/removing operation.

The main object of the present invention is to provide a method, a device and a plant able to eliminate the drawbacks and shortcomings of the prior art and to allow a reuse of both components of different materials, for example cleaned cast iron pieces and compressed coal dust pieces, by using of only one cleaning device or plant.

Another object of the present invention is to achieve both a high cleaning degree of the cast iron pieces and a high cleaning efficiency of the coal piece cleaning step, as well as to eliminate the coal dust emission in the work environment.

Still another object of the present invention is to separately collect the reusable fine coal dust removed from the cast iron pieces and the contaminating film to discard fine coal fraction from the coal pieces.

These and other objects are achieved with a method, a device and a plant for cleaning irregular pieces of different materials which present the features recited in the independent claims.

Further developments and advantageous embodiments of the present invention are set forth in the dependent claims.

SUMMARY OF THE INVENTION

With the method, device and plant according to the present invention it is possible to achieve several advantages.

First of all, the efficient, desired and different cleaning actions carried out, for example, onto the pieces of the metallic component and the coal component obtained from the starting coal "cakes" or blocks for pyrolysis processes as a function of only the direction of rotation of a single cleaning device allow to utilize only one treatment/cleaning device.

Furthermore, the desired cleaning degree may reliably be achieved with a continuous operation independently of the cleaning device length by a sequence of cleaning cycles.

Still another advantage is to obtain an optimum cleaning degree of both the harder cast iron pieces and the softer coal pieces in a considerably shorter time with reference to the prior art.

Furthermore, the treatment/cleaning time as well as the number of cleaning cycles can advantageously be easily decided either by an operator based on a visual checking or automatically based on an optic checking by an optic detector and cleaning reference values obtained in practice.

The achieving of both said different cleaning actions in the same treating/cleaning device obviously allows a remarkable reduction of the expenditure for apparatuses and control/adjusting circuits and requires only a small installation surface.

The used apparatuses and conveying tapes can be easily and cheaply cladded so that noises are reduced and the harmful coal dust emissions are eliminated, which also allows an installation of the cleaning device and plant under a covering, that is, for example, in a shed or the like.

A changing-over from the cleaning step for cast iron pieces to that for coal pieces may take place instantaneously and does not require any preliminary conversion of the cleaning device or a tool substitution.

Another advantage is to be seen in the fact that the collecting of the fine coal fractions may take place automatically both during the piece feeding step and the cleaning step of the pieces to be cleaned and, therefore, separated recovering or collecting steps are not necessary.

With the feature of claim 2 can be obtained a quick and efficient removing of the coal parts sticking onto the cast iron pieces and a discharging of the removed coal parts which latter during the cleaning step are automatically crushed with a fine granulometry.

A surprisingly simply, efficient and total removal of the contaminating film can be achieved with the teaching of claim 3 which is based on the fact that the inventor has established that said contaminating film has a lower mechanical resistance and consistency and is more crumbly than the coal pieces consisting of compressed coal dust.

The features set forth in claim 4 allow to adjust the productivity of the cleaning device or plant when cleaning both the metal and coal components in a simple way and with usual components of the adjusting technique.

With the feature of claim 6 has been achieved in practice an efficient and continuous elimination of the coal fine fraction in the cleaning device during the cleaning step itself.

Simple embodiments of the cleaning tools can be constructed with the teaching of claim 7 which further suggests another measure for avoiding possible distortions of the free edge of said cleaning tools which distortions could hinder a free sliding and a following free fall by gravity of the pieces onto the lifted tools and is illustrated in FIG. 9.

The configuration of the treatment/cleaning tools set forth in claim 8 guarantees a high cleaning efficiency of both the metal and the coal components.

The cleaning tools suggested in claim 9 can be constructed in a simple and inexpensive manner and can be easily fastened to the cleaning jacket, for example by welding or screwing.

The embodiment of the tools according to claim 10 can be constructed in a very simple, quick and inexpensive way and ensures a high cleaning efficiency.

With the cleaning tools disclosed in claim 11 it is possible to obtain—with straight tools—an easy adjustment of the productivity by varying down from above the output end of the cleaning jacket, and—with helicoidal tools—to obtain an automatic discharging of the cleaned material without any tilting of said cleaning jacket, the productivity adjusting being easily obtained by varying the rotation speed of said cleaning jacket.

A good balancing of the cleaning jacket during the rotation thereof may be achieved with the teaching of claim 12.

Claim 14 teaches an embodiment of a feeder-separator for feeding the materials to be cleaned which is easy to construct, simple to adjust and has a reliable operation.

A simple construction for conveying the fine coal fractions on a discharging belt is suggested in claim 15.

The conveying path disclosed in claim 16 can be carried out with a development at will which may be further easily adapted to the planimetry of the respectively considered installation area and can be further composed with usual components.

The feature stated in claim 17 allows to automate the entire cleaning cycle/operation by using usual components of the analogical and digital techniques, an appropriate control program co-operating with a microprocessor as well as stored reference cleaning degree values previously determined in practice.

With the feature set forth in claim 18 it is possible to comply with the noise limits prescribed by the specifications for installations in sheds as well as to avoid an harmful emission of coal dust in the working environment during the cleaning operation.

The teaching of claim 19 allows to automatically carry out the operation of the plant according to the present invention even in the case of a plant installed inside a shed and closed by a cladding or case.

The measure set forth in claim 19 aims to obtain cleaning tools having a long life and easy to restore by substituting a removable part thereof, for example a liner consisting of hardened metal.

BRIEF DESCRIPTION OF THE DRAWINGS

Further details, features and advantages of the method, device and plant for cleaning irregular pieces consisting of different materials according to the present invention will be more apparent from the following description of preferred, though not exclusive or restrictive, embodiments which are schematically illustrated in the accompanying drawings in which:

FIG. 9 shows cross-sectional views of the cleaning tools of FIGS. 5, 6 and 7 with rounded free edge;

FIGS. 10 and 11 are schematic horizontal sectional views along the cleaning jacket or device of FIG. 1 with further embodiments of the configuration and arrangement of the cleaning tools; and FIG. 12 shows a cross-sectional view of another embodiment of the cleaning tools.

DETAIL DESCRIPTION OF THE INVENTION

In the shown example the materials to be alternatively and independently from one another cleaned by reason of the reuse thereof are formed by so called "cakes" or blocks for pyrolysis process and consist of two components, that is a first component made of cast iron pieces having a granulometry smaller than, for example, 20 cm and on which are still firmly sticking residual agglomerations of compressed coal dust, and a second component made of pieces or agglomerations of compressed coal dust which may present outer zones or portions of a contaminating film, said both components being obtained by a preliminary breaking of said "cakes" or blocks which are formed or compressed coal dust and incorporate cup-like bodies of cast iron, as known for pryolysis processes, and recalled in the introductory part.

The method according to the present invention, and which will be more easily understood from the following, is carried out according to the invention in only one treatment/cleaning device for both the components to be cleaned and is denoted in its totality by 1. Said cleaning device 1 is formed by a cylindrical jacket-like container 2 in the example illustrated in FIGS. 1, 5, 6 and 7 or in the form of a polygonal, for example octagonal, jacket, as shown in FIG. 8.

Figure 2:
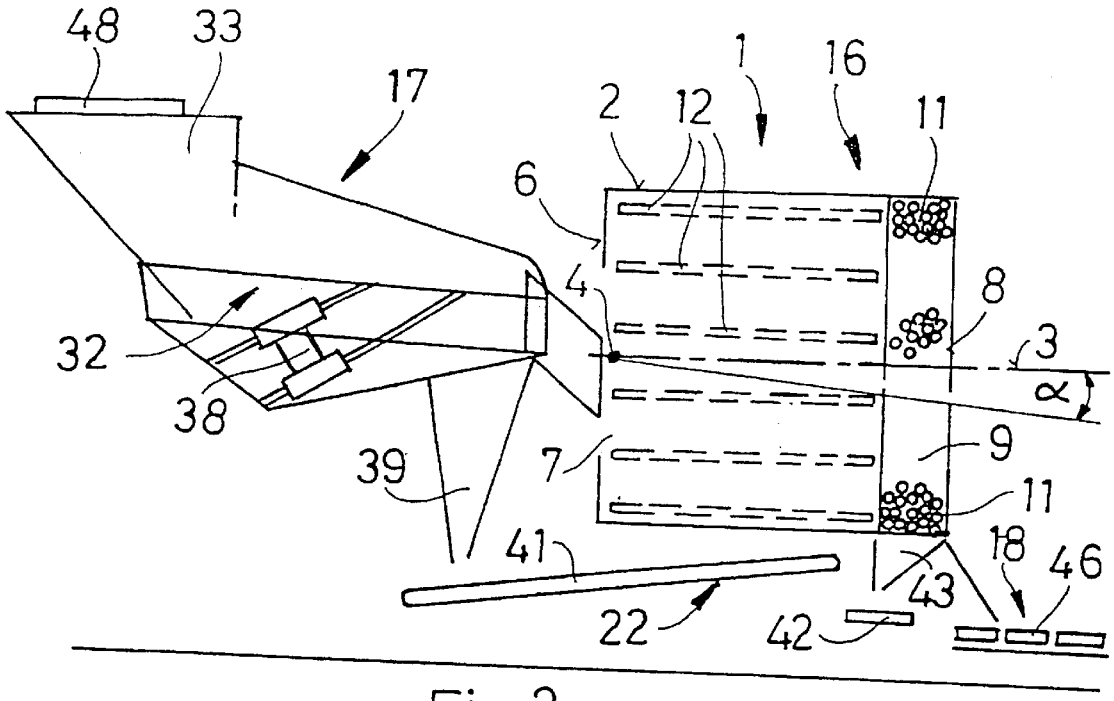
FIG. 2 is a cross-sectional view of the plant of FIG. 1 taken along the sectional line II—II of FIG. 1.
Figure 3:
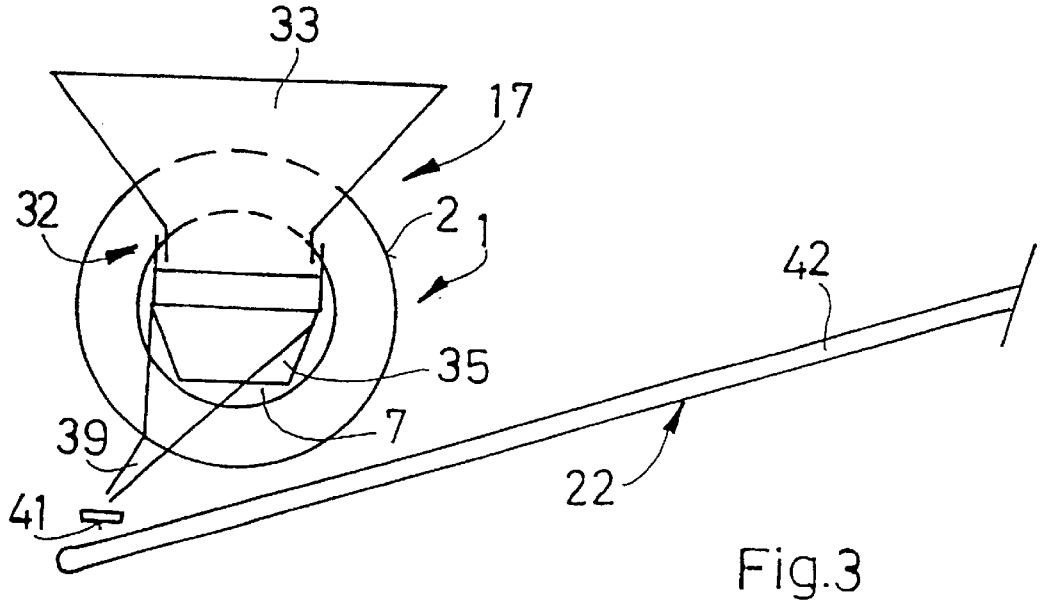
FIG. 3 is a schematic partial side view of the plant of FIG. 1 seen from the arrow A in FIG. 1.
Figure 4:
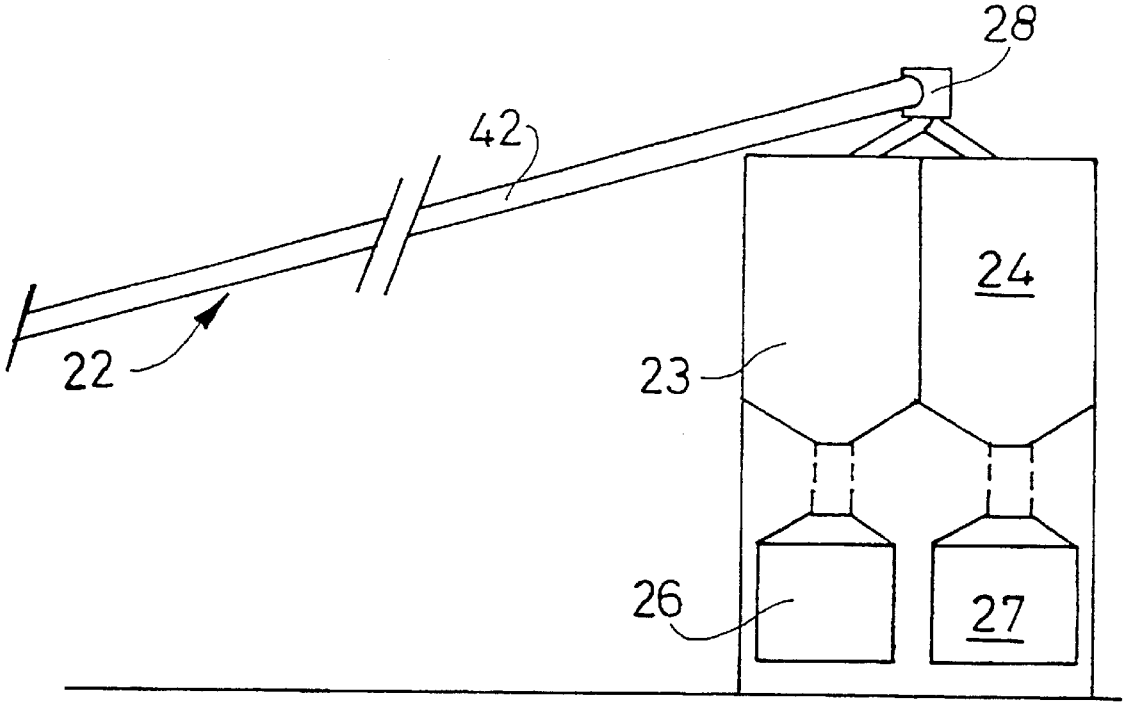
FIG. 4 is a schematic view of the collecting devices for collecting the fine coal reusable and discard fractions of the plant of FIG. 1.

Said container or jacket 2 is rotatably supported in both directions of rotation around its longitudinal and substantially horizontal axis 3 by means of a not shown geared motor and trough a perimetral likewise not shown frame is pivoted in 4 at the inlet or feeding end 6 and can therefore swing in the vertical longitudinal plane by means of known and not shown lifting means, for example piston/cylinder units, the angle $\alpha$ shown in FIG. 2 illustrates an oscillation angle with respect to the horizontal. The supporting system of said jacket 2 is not shown in detail as it can be easily made by a person skilled in the art.

The anterior or feeding end 6 of the jacket has a substantially middle charging aperture 7 whereas the posterior or discharging end thereof for discharging the cleaned material is designated 8 and is open.

A circumferential band is designated 9 and has perforations 11 allowing a direct discharging by gravity of the fine coal dust fraction. In the shown example said foraminous band 9 is provided at the discharging end 8 of the jacket 2 and has a length of about 50 cm with diameters of said perforations 11 in the range of 10–20 mm.

According to the present invention, the jacket 2 has a large diameter of, for example, 2.5 m in order to reach high fall heights able to ensure a reliable efficiency in removing the sticking coal parts from the cast iron pieces when the latter impact the iron pieces in the jacket lower part.

On the internal surface of said jacket 2 along generating lines are uniformly arranged and fastened treatment/cleaning tools 12 which substantially extend between the feeding end 6 and the foraminous band 9 and allow the cleaning of alternatively both types of materials without any preliminar conversion intervention but only by the choice of the direction of rotation of said jacket 2 as explained hereinafter.

Figure 5:
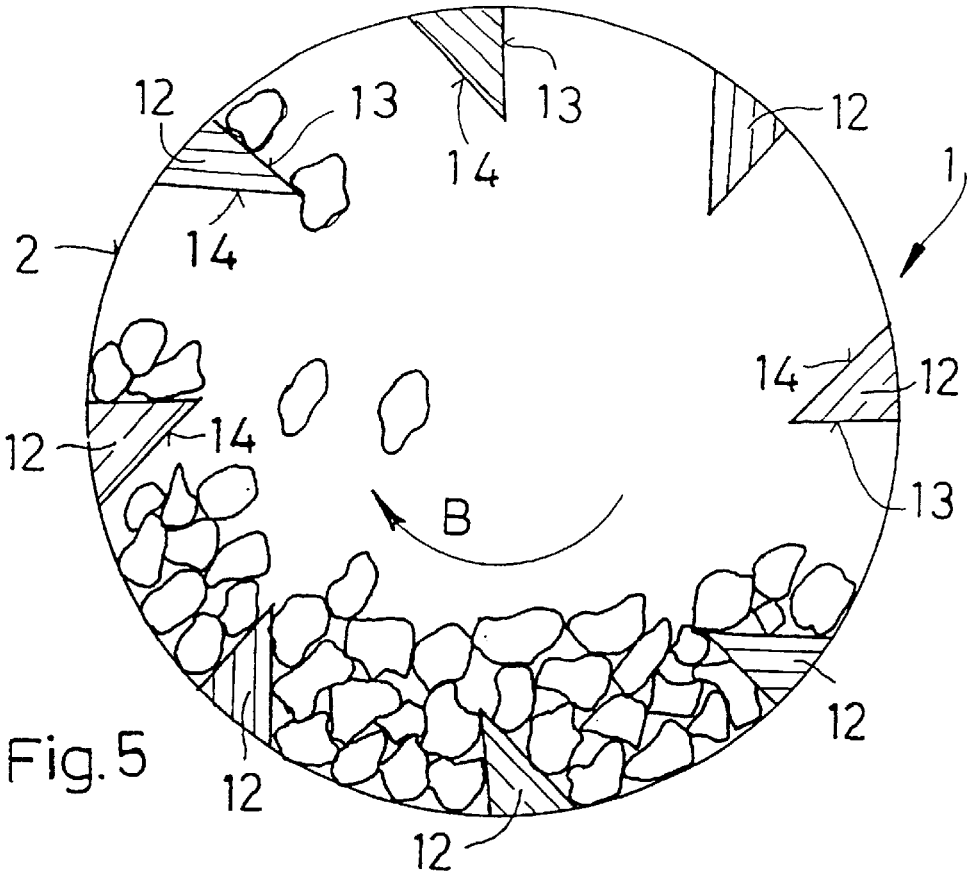
FIG. 5 is a vertical cross-sectional view on of the cleaning device of the plant of FIG. 1 during the cleaning step of the metal pieces or component.
Figure 6:
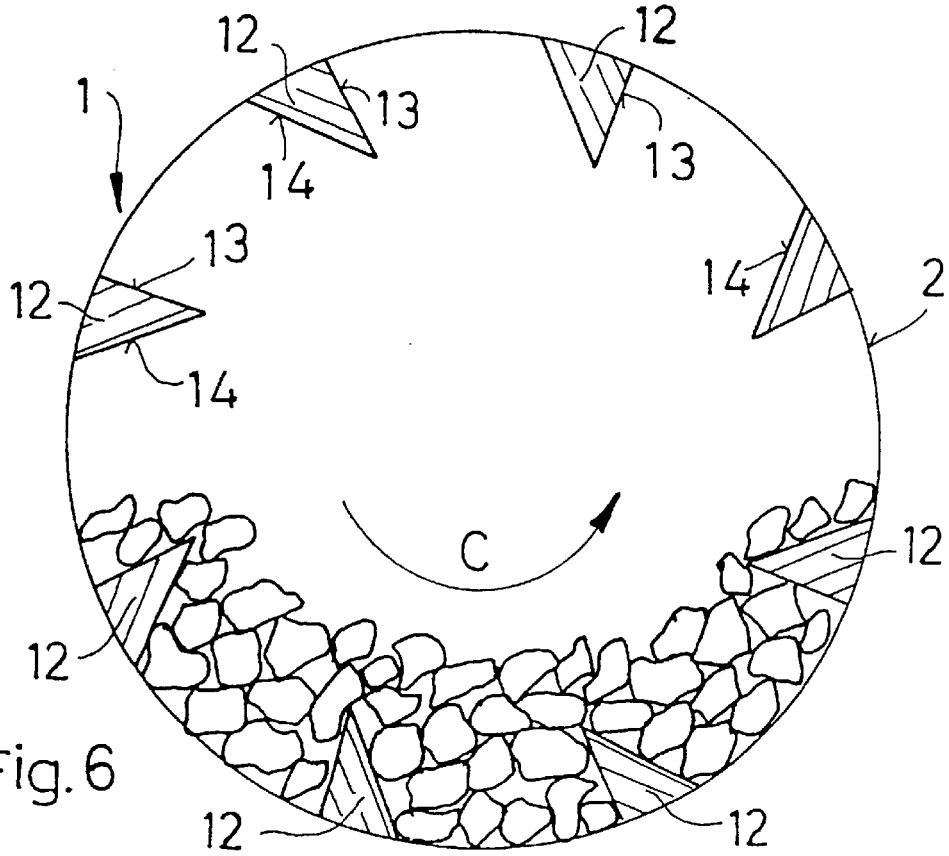
FIG. 6 is a vertical cross-sectional view like FIG. 5 but during the cleaning step of the coal pieces or component.

For this purpose the tools 12 have two cleaning sides 13 and 14 with a different geometrical configuration and are able to carry out a mixing-rubbing-lifting-fall action the one tool side 13 and a mixing-rubbing action the other tool side 14. This can be obtained by using rotatable tools 12 which have an asymmetrical cross-section, for example in principle a rectangular-triangle-like cross-section as shown in FIGS. 5 and 6. These tools, like the embodiments shown for example in FIGS. 7 and 8 can, therefore, each carry out the actions of two assembled tools and are constructed, for example, by cutting quadrangular solid sections along a diagonal thereof, from bars having a triangular cross-section, by bending thick steel plate, by welding parts of thick steel plate, and so on.

In practice all tools 12 have a flat or concave lifting side 13 which is substantially at right angle to the jacket 2 or forms an undercut, that is an acute angle $\beta$ with the latter whereas the mixing tool side 14 forms an inclined plane forming an obtuse angle $\gamma$ with respect to said jacket 2, said sides 13 and 14 being respectively active with the associated direction of rotation, as shown in FIGS. 5 and 6.

Figure 1:
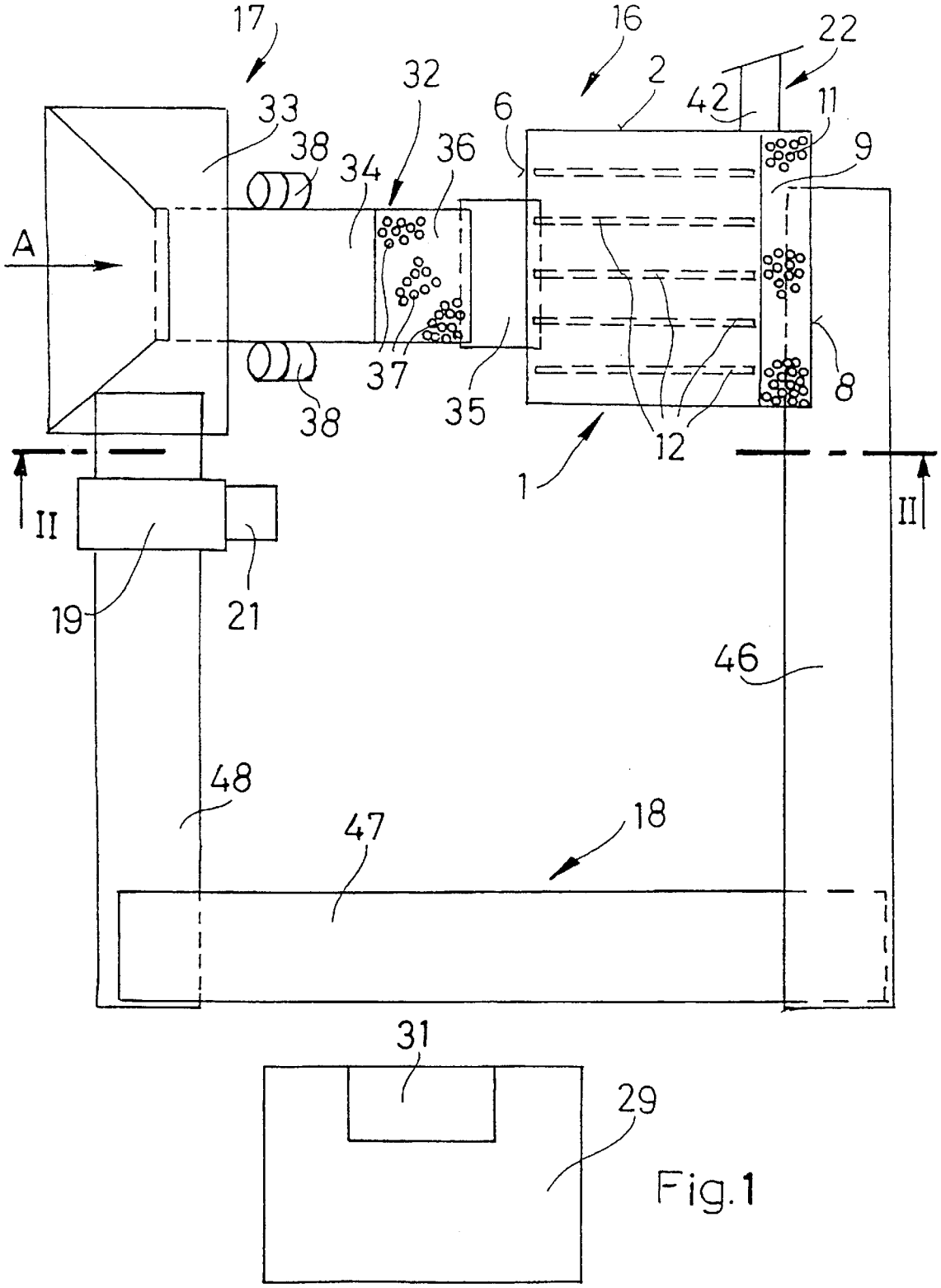
FIG. 1 is a plan top view of a cleaning plant according to the present invention.

In a first embodiment the extension of the cleaning tools 12 could be straight, as shown in FIGS. 1 and 2 whereas in a second not shown embodiment they could have an helicoidal extension, in which case the cleaning tools 12 during the operation besides the cleaning action will simultaneously carry out a longitudinal graduated material feed action, that is a graduated or progressive discharging of the material being treated. The fastening of said tools 12 could be made by welding, with screws or with any other adapted system.

In order to obtain in operation a uniformly balanced rotation of the cleaning jacket 2 it is suggested to make the cleaning tools in form of modular sectors 12A having a length of, for example, 30–80 cm and arranged spaced apart along jacket generating lines or helicoidal lines, and circumferentially offset (FIGS. 10 and 11). In the arrangement along helicoidal lines (FIG. 11) the sector tools 12A will simultaneously determine a gradual feed of the material being treated even in the case of a substantially horizontal position of the jacket longitudinal axis 3.

In order to reliably obtain the desired cleaning action by means of only one pass of the material through the cleaning device 1, the jacket 2 should have a remarkable length indeed and would be correrspondingly expensive. Furthermore, such a cleaning device is mainly adapted for carrying out a batch operation.

In order to obtain the respectively desired cleaning degree of the cleaned material irrispective of the jacket length and the necessary cleaning time, the present invention suggests further, on the one hand to advantageously reduce the jacket length in the magnitude order of, for example, 2.5 m and to provide on the other hand a cleaning method involving a plurality of repeatable cleaning cycles, which are preferably carried out under supervision of an operator or, alternatively, automatically, as illustrated hereinafter.

The cleaning device 1 is advantageously included in a cleaning plant 16 according to the present invention as illustrated in FIGS. 1 to 4. In accordance with the present invention, the cleaning plant comprises mainly:

- a cleaning device 1 as illustrated above,
- a feeding device 17 for feeding the material/pieces to be cleaned,
- a circulating path 18 for delivering the material cleaned in one cycle and connecting the discharging end 8 of the cleaning jacket 2 to the feeding device 17, which circulating path 18 upstream from the said feeding device 17 includes a controllable switch 19 for conveying the cleaned material at will to the feeding device 17 for carrying out a further cleaning cycle or—trough a switch outlet 21—to a not shown collecting point for the reusable cleaned material,
- a discharging path 22 (FIGS. 2 and 3) for discharging both the fine reusable or discard coal fractions, as illustrated hereinafter,
- two distinct collecting devices 23 and 24 (FIG. 4) provided for example with a known big bag 26 and 27, respectively, for distinctly collecting said fine coal dust reusable (23, 26) and discard (24, 27) fraction conveyed by the path 22, wherein the latter also includes a switch 28 for said distinct collecting of each of said both coal dust fractions in the one or the other collecting device 23, 26 and 24, 27, as well as
- a visual controlling and checking position 29 (FIG. 1) for a visual supervision of the cleaning degree of the cleaned material by an operator or an optic detector, and containing a control board 31 allowing to adjust the driving means of the components of said plant 16.

With more details, said feeding device 17 comprises a feeder-separator 32 disposed between a feeding hopper 33 receiving the material or component to be cleaned by a power loader or excavator, not shown, and a chute 35 discharging the material to be cleaned into the cleaning device 1. The feeder-separator 32 is, for example, a vibrating screen and has an initial blind plate part 34 and a foraminous end part 36 provided with perforations or holes 37 which have a diameter in the range of, for example, 10–20 mm. Furthermore, to said feeder-separator 32 are associated known controllable vibrating means 38.

FIG. 2 illustrates that below the end perforated part 35 is placed an hopper 39 discharging the fine coal dust fraction on a first conveying belt 41 of the discharging path 22, which belt 41 in turn, in the shown example, conveys said coal fraction onto the further discharging belt 42 which also receives the fine coal dust fraction from the foraminous end band 9 of the jacket 2 guided by the underlying hopper 43 and conveys said both fine consecutive fractions into the collecting devices 23, 26 or 24, 27.

The circulating or cycling path 18 conveying the cyclic cleaned material may be formed by a single belt or more belts, for example three consecutive conveying belts 46, 47 and 48, as shown.

Figure 7:
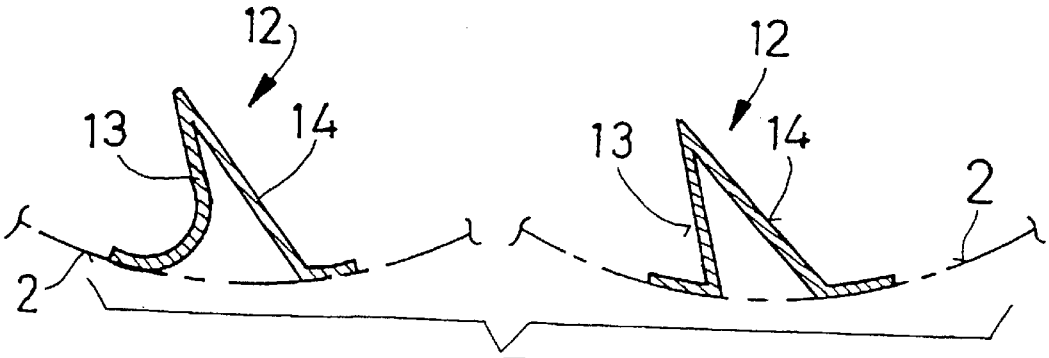
FIG. 7 shows cross-sectional views of two embodiments of cleaning tools according to the present invention.
Figure 8:
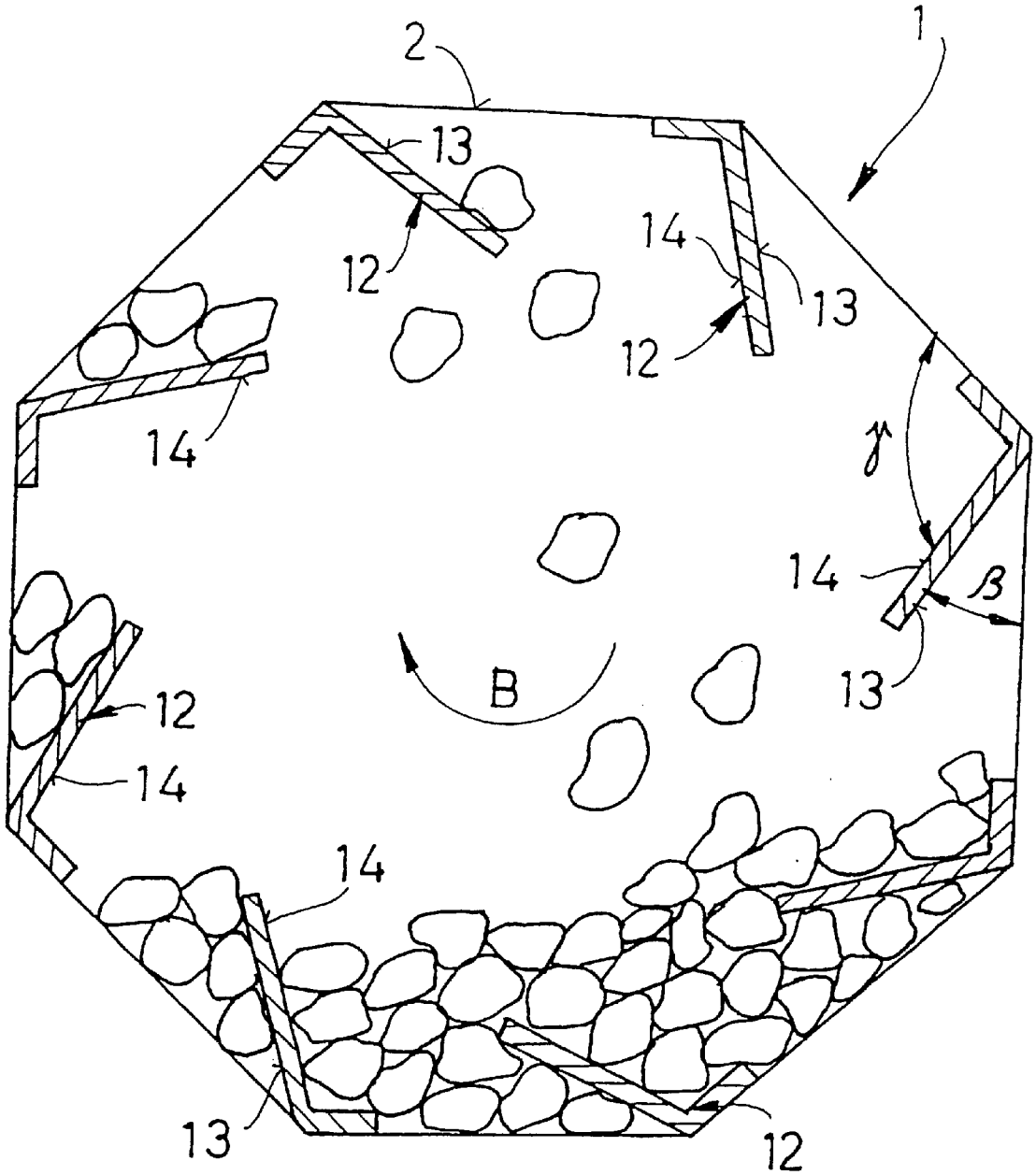
FIG. 8 is a vertical cross-sectional view on of a cleaning device of the type illustrated in FIG. 1 with another embodiment of the cleaning tools.

FIG. 7 shows two embodiments of cleaning tools 12, which allow to increase the material fall height, and therefore the cleaning efficiency and may be easily constructed by bending a thick steel plate or welding steel plate parts.

A high cleaning efficiency is also achievable with the polygonal cleaning jacket and the cleaning tools shown in FIG. 8.

When installed for example in a shed, the feeding device 17 and the cleaning device 1 are contained in an own soundproofing and the flying volatile coal dust capturing cladding or case, and the conveying belts of said conveyor paths 18 and 22 are provided in a covered or closed embodiment. Said cladding and covered conveyor belts are not illustrated as they are per se known and may be easily constructed by a technician skilled in the art.

The operation of the cleaning device 1 as well as the operation with repeatable cleaning cycles of the cleaning plant 16 according to the invention will now be described in the following in relation to the description of the wholly cleaning plant 16 itself.

The respectively considered material to be cleaned, that is the metal component and the coal component is fed into the charging hopper 33 and passes through the feeder-separator 32 which continuously by vibrating conveys said material into the rotating cleaning device 1 through the chute 35. When passing on the end part 36 the removed fine coal fraction will fall through the perforations 37 on the underlying belt 41 of the discharging path 22.

Assuming first to clean the metal component, the cleaning jacket 2 will be rotated clockwise, arrow B in FIG. 5, so that the cast iron pieces gathering up on the round bottom jacket part in rather compacted form due to the cylindrical or polygonal form of the jacket and by gravity, will first be pushed the one against the other and thereby mutually mixed with a rubbing action and then lifted by the lifting side 13 of the cleaning tools 12 and will then slide on the downward directed tool side 13 and fall by gravity from the upper part of the jacket 2 with subsequent random impact on the underlying pieces, the combined mutual rubbing action between the pieces first and the fall crush action thereafter will ensure a progressive removing action from the metal pieces of the compressed coal dust sticking thereon.

The coal fraction removed from the metal pieces and crushed in a fine granulometry during the jacket rotation by a rubbing or crushing action will fall by gravity through the holes of said perforation 11 on the conveying belt 42 and will be discharged by the discharging path 22 and the switch 28 into the collecting device with big bag 23, 26 for the reusable fine coal fraction because the latter does not contain parts of contaminating film.

The more or less cleaned cast iron pieces are then discharged on the conveying belt 46 of the circulating path 18 and before the visual checking position 29. An operator in said checking position 29 is therefore able to visually check the cleaning degree of the treated pieces and control, by means of the control board 31 and the switch 19, either the discharging of the circulating cleaned material through the switch outlet 21—if the cast iron pieces are sufficiently cleaned for a reuse thereof—, or the further feeding of said circulating pieces into the charging hopper 33 for carrying out a further cleaning cycle and so on.

It should be noted that the discharging of the material from the jacket 2 may be facilitated by tilting downward the jacket discharging end 8. It also should be noted that by increasing the vibrating action on the feeder-separator 32 the quantity of material fed into the cleaning jacket 2 is increased.

Assuming now to clean the material component only composed of pieces of compressed coal dust, it will be sufficient to change the direction of rotation of the jacket 2, as shown by the arrow C in FIG. 6, which causes the tool side 14 to become active.

This will cause a mutual rolling-rubbing-mixing action onto the coal pieces lying on the jacket lower part with consequent simultaneously abrasion action on the outer surface of said coal pieces, which will cause an efficient removal of the contaminating film, which latter—as the inventor has found out—is weaker and more crumbly than the pieces of compressed coal dust. An efficient and quick removal action of the contaminating film, that is a cleaning action of the coal pieces is therefore achieved. For the other aspects is valid what described above in relation with the removing cleaning action of the cast iron component with the difference that the removed fine coal fraction will contain particles of contaminating film and therefore must be eliminated.

For this purpose said fine coal fractions are discharged through the switch 28 and collected in the collecting device with big bag 24, 27.

The operator interventions for visually checking or verifying the actual cleaning degree of the cast iron or coal pieces, that is for determining the necessary cleaning cycles may also be carried out automatically by means of an optic detector, for example a colorimeter, operatively connected to a specific microprocessor with appropriate control program and stored values of reference piece cleaning degree.

Further details about the microprocessor and the control program therefor are omitted as said microprocessor may be available from the market and a performance of the control program may be easily done by a technician skilled in the art.

Furthermore, in order to achieve a rather uniform and balanced rotation of the rotatable cleaning jacket, the cleaning tools 12 may be constructed in the form of modular segments 12A (FIGS. 10 and 11) having a length of, for example, 30–80 cm and disposed uniformly spaced apart from each other along jacket generating lines (FIG. 10) or along helicoidal lines (FIG. 11) as well as circumferentially offset.

From FIG. 12 is further inferable that in order to reduce the operation costs the cleaning tools 12 or 12A may consist of a core 50 of ordinary steel and an outer covering 51 of hardened steel, which latter may be preferably removably fastened to said core 50, for example by means of screws indicated by the axes 52 thereof.

Alternatively, it would also obviously be possible to provide only a removable part of hardened steel in the form of a pointed, rounded or chamfred rod-like free edge of said cleaning tools 12, 12A.

After considering the above description the understanding of the cleaning method of both components of said "cakes" or blocks for pyrolysis according to the present invention will be facilitated. Said cleaning method can be carried out with the suggested and above illustrated cleaning devices and cleaning plant and it provides the distinct accomplishment in only one cleaning device—which is rotatably supported in both directions of rotation—of:

a) a cleaning step for cleaning the cast iron pieces while simultaneously removing from the latter and discharging the thereon sticking coal parts, in which cleaning step the cleaning device is rotating in one direction of rotation, and b) a cleaning step for cleaning the coal pieces while simultaneously removing from the latter and discharging the contaminating coal film portions sticking thereon, in which cleaning step the cleaning device is rotating in the other direction of rotation, wherein the different cleaning actions onto both said cast iron and coal pieces are accomplished by means of asymmetric tools having geometrical different operative sides provided in said cleaning device, and wherein when using a cleaning treatment device having a rather limited device length is provided a number and a duration of subsequent cleaning cycles of said pieces to be cleaned into the cleaning device which number and duration may be determined by an operator or an optic detector as a function of the desired piece cleaning degree.

Moreover, according to the proposed method the cleaning step a) is carried out by a composite mutual mixing and rubbing action of the cast iron pieces in the lower part of the cleaning jacket and a considerable lifting of said iron pieces with subsequent fall per gravity and random impact thereof onto the underlying metal pieces with consequent removal of the adhering coal parts and progressive reduction of the piece granulometry, wherein the removed fine coal fraction falls by gravity through perforations in the cleaning jacket and is collected for the reuse thereof.

According to the inventive method, the cleaning step b) is carried out by a mutual rubbing and rolling or mixing action of the coal pieces in the lower part of the cleaning jacket with consequent removing by abrasion of the softer contaminating film, wherein the fine coal fraction containing removed particles of contaminating film falls by gravity through said perforations in said cleaning jacket and is separately collected.

It is further possible to easily adjust the cleaned product discharge or productivity by varying the speed of rotation of the cleaning device and/or by varying the tilt of said cleaning device by lowering the discharging action thereof with respect to the substantially horizontal axis of said cleaning device.

From the foregoing it is further inferable that with the cleaning method, device and plant according to the present invention it is possible to efficiently achieve the objects set forth and to obtain the above mentioned advantages.

In practice it is possible to carry out modifications and alterations as, for example, to provide a cleaning jacket in the form of a concrete mixer or conveying paths of the cleaned material and the fine coal fractions having a different development of that illustrated, and so on, without leaving the scope of the invention.

It is further within the scope of the present invention to provide a feeding hopper which is separated from the feeding device, for example in the form of a vibrating screen, a feeding screw or the like and preferably provided with a foraminated part and an underlying hopper for discharging the fine coal fraction directly on the conveyor belt which receives the fine coal fraction from the cleaning jacket, or to provide a cleaning jacket without a foraminated band acting as a screen and to provide a downstream screen, and so on, without leaving the scope of the present invention.

Besides the mentioned composed coal-cast iron "cakes" for pyrolysis processes and the like, the cleaning method, device and plant according to the present invention can also be utilized in all fields in which two components of different materials, or with a different hardness or mechanical resistance are to be cleaned as, for example, in casting houses where there are metal pieces having sand agglomerations sticking thereon, in building where there are wooden boards having concrete agglomerations adhering thereon, or the like, without likewise leaving the scope of the present invention.

It is obvious that in all cases the sizing of the cleaning device or jacket, the cleaning tools and the plant components will take place considering the dimensions and mechanical features of the material to be cleaned.

What is claimed is:

1. Method for cleaning irregular pieces comprising cast iron pieces with parts of compressed coal dust sticking thereon and coal pieces made of compressed coal dust carrying thereon contaminating coal film portions, said pieces having been obtained by a preliminary step of breaking blocks of compressed carbon dust incorporating cup-shaped cast iron pieces, said cleaning method being carried out in a single cleaning device, which is rotatably supported in both directions of rotation, alternatively and independently from one another, the method comprising:

a) a cleaning step for cleaning the cast iron pieces while simultaneously removing from the cast iron pieces and discharging the sticking coal parts, in which cleaning step the cleaning device is rotating in one direction of rotation; and b) a cleaning step for cleaning the coal pieces while simultaneously removing from the coal pieces and discharging the contaminating coal film portions, in which cleaning step the cleaning device is rotating in the other direction of rotation;

wherein the different cleaning actions onto both said cast iron and coal pieces are accomplished by asymmetric tools having geometrical different operative sides provided in said cleaning device, and wherein a number and a duration of subsequent cleaning cycles of said pieces to be cleaned into the cleaning device are determined by an operator or an optic detector as a function of the desired piece cleaning degree.

2. The method according to claim 1, wherein the cleaning step a) is carried out by a composite mutual mixing and rubbing action of the cast iron pieces in a lower part of a cleaning jacket and a considerable lifting of said cast iron pieces with subsequent fall by gravity and random impact thereof onto the underlying metal pieces with consequent removal of the adhering coal parts and progressive reduction of the piece granulometry, and a fine coal fraction falls by gravity through perforations in the cleaning jacket and is collected for reuse.

3. The method according to claim 1, wherein the cleaning step b) is carried out by a mutual rubbing and rolling or mixing action of the coal pieces in a lower part of a cleaning jacket with consequent removing by abrasion of the contaminating coal film, and a fine coal fraction containing removed particles of contaminating film falls by gravity through perforations in said cleaning jacket and is separately collected.

4. The method according to claim 1, wherein the cleaning device has a discharging end, a speed of rotation, a slant, a substantially horizontal axis, and the productivity of said cleaning steps is adjustable by varying at least one of the speed of rotation and the slant of said cleaning device by lowering the discharging end with respect to the substantially horizontal axis.

5. Device for cleaning irregular pieces comprising cast iron pieces with parts of compressed coal dust sticking thereon and coal pieces made of compressed coal dust carrying thereon contaminating coal film portions, said pieces having been obtained by a preliminary step of breaking blocks of compressed carbon dust incorporating cup-shaped cast iron pieces, said device comprising:

a substantially cylindrical or polygonal jacket which is rotatably supported in both directions of rotation around a longitudinal substantially horizontal axis and can swing in a vertical longitudinal plane thereof, said jacket having a feeding end with a substantially middle feeding aperture and an open discharging end for discharging cleaned pieces, and at least a circumferential band provided with perforations for directly discharging by gravity a fine coal fraction to be discharged or alternatively said jacket being provided with an associated vibrating screen, asymmetric treating tools having geometrical different treating sides being mounted on an inner surface of said jacket; and wherein the cleaned pieces are discharged by gravity from the jacket discharging end.

6. The device according to claim 5, wherein said circumferentially perforated band is provided at the discharging end of said jacket and has a length of 30–80 cm; the perforations for the direct discharging of the fine coal fraction having a diameter in the range of 10–20 mm; said jacket having a diameter of about 2.5 m and in case of an operation with consecutive cleaning cycles a length of about 2.5 m.

7. The device according to claim 6, wherein said treating tools are formed from solid or hollow sections having an asymmetric cross-section and have a chamfered or rounded free edge.

8. The device according to claim 7, wherein the sections forming said treating tools have:

a first lifting side which is at least one of a) flat and substantially at right angle to said jacket, b) defines with said jacket an acute angle, c) is concave, and d) forms an undercut with respect to said jacket; and a second rubbing side, which is opposite to said first lifting side, and is inclined with respect to said jacket, and defines with said jacket an obtuse angle.

9. The device according to claim 8, wherein said treating tools are made of solid or hollow sections having a substantially triangular cross-section, and the fixing of said tools on said jacket is made along a triangle cathetus.

10. The device according to claim 5, wherein said treating tools are obtained from a bent list of thick sheet steel having a flange-shaped bent foot for fixing the tools on said jacket.

11. The device according to claim 5, wherein said treating tools are straight like jacket generating lines or have a helicoidal extension.

12. The device according to claim 5, wherein said treating tools are provided in the form of modular sectors having a length of 30–80 cm and are disposed spaced apart from one another either in a jacket longitudinal direction or along helicoidal lines, and are also offset in a circumferential direction.

13. The cleaning device according to claim 5, wherein said treating tools have a core consisting steel and are provided with either an outer removable lining covering the outer surface of said treating tools or with a removable free edge; said removable lining or free edge being made of hardened steel and being fastened to said tool core.

14. Plant for cleaning irregular pieces consisting of different materials, which comprises:

a cleaning device comprising a substantially cylindrical or polygonal jacket which is rotatably supported in both directions of rotation around a longitudinal substantially horizontal axis and can swing in a vertical longitudinal plane thereof; said jacket having a feeding end with a substantially middle feeding aperture and an open discharging end for discharging cleaned pieces, and at least a circumferential band provided with perforations for directly discharging by gravity a fine coal fraction to be discharged or alternatively said jacket being provided with an associated vibrating screen;

a feeding device for feeding the pieces to be cleaned into the jacket of said cleaning device;

a circulating path for conveying the cleaned pieces from the cleaning device to the feeding device, wherein upstream of the feeding device is provided a switch adapted to conduct at will the cleaned pieces into the feeding device again to carry out a new cleaning cycle, or through a switch outlet, to a collecting point for reuse of cleaned material;

a discharging path for independently discharging fine reusable or discard coal fraction in a respective collecting device, wherein upstream said collecting device is provided a switch adapted to conduct said fine reusable or discard coal fraction into one or another of said collecting devices; and a visual checking position for a visual supervision of the cleaning degrees of the cleaned material by an operator or automatically by an optic detector, and containing a control board for controlling driving means of components of said plant.

15. The plant according to claim 14, wherein said feeding device comprises a feeder-separator placed between a charging hopper and the jacket; and said feeder-separator including a vibrating screen and comprising a sheet-shaped initial part and a foraminous end part provided with perforations having a diameter ranging between 10 and 20 mm for direct discharging by gravity the fine coal fraction.

16. The plant according to claim 15, further comprising a guiding hopper positioned beneath the foraminous end part of said feeder-separator for guiding the fine coal fraction onto the discharging path leading to said collecting devices.

17. The plant according to claim 16, wherein the circulating path delivering the cleaned pieces from the jacket to the feeder-separator comprises one or more delivering tapes which are placed consecutively in order to form a loop conveyor.

18. The plant according to claim 14, wherein the optic detector co-operates with a microprocessor unit with an appropriate program and reference cleaning values for automatically controlling the cleaning cycles as a function of the desired cleaning degree of the cleaned pieces.

19. The plant according to claim 17, wherein when the plant is installed in a shed, the jacket and the feeding device are housed in an own soundproofing and the volatile coal dust capturing cladding and the conveyor tapes defining the cleaned pieces delivering and the fine coal fraction discharging paths are convered.

20. The plant according to claim 19, wherein said soundproofing and the coal powders capturing cladding are housed in a transparent window allowing a visual checking of the cleaning degree of circulating cleaned pieces.

* * * * *